US007583177B1

(12) United States Patent
Fan et al.

(10) Patent No.: US 7,583,177 B1
(45) Date of Patent: Sep. 1, 2009

(54) VARIABLE RESISTOR WITHOUT ROTATION ANGLE LIMITATION AND HAVING REGULAR CHANGES IN RESISTANCE VALUE

(75) Inventors: Yang-Kang Fan, Miaoli Hsien (TW); Yang-Hung Fan, Miaoli Hsien (TW)

(73) Assignee: Men-Tech Industrial Co., Ltd., Miaoli Hsien (TW)

( * ) Notice: Subject to any disclaimer, the term of this patent is extended or adjusted under 35 U.S.C. 154(b) by 0 days.

(21) Appl. No.: 12/179,698

(22) Filed: Jul. 25, 2008

(51) Int. Cl.
*H01C 10/32* (2006.01)

(52) U.S. Cl. ..... 338/171; 338/162

(58) Field of Classification Search ..... 338/160–163, 338/171, 177
See application file for complete search history.

(56) References Cited

U.S. PATENT DOCUMENTS 4,521,761 A * 6/1985 Welch ..... 338/174
6,380,841 B2 * 4/2002 Masuda et al. ..... 338/163
6,434,815 B1 * 8/2002 Onishi et al. ..... 29/621
6,469,613 B2 * 10/2002 Miura ..... 338/162

* cited by examiner

*Primary Examiner*—Kyung Lee
(74) *Attorney, Agent, or Firm*—Rabin & Berdo, P.C.

(57) ABSTRACT

A variable resistor has a substrate, an insulating film, a resistance element, a rotary assembly and a wiper. The substrate has a first terminal having an annular segment, a second terminal and a third terminal having a semi-circular segment disposed adjacent to the annular segment of the first terminal. The insulating film has a central hole corresponding to the annular segment and covers the second terminal and the semi-circular segment. The resistance element is mounted on the insulating film and contacts the second terminal and the distal end of the semi-circular segment through two gaps of the insulating film. The rotary assembly is mounted on the substrate. The wiper is rotated by the rotary assembly and has multiple contacts respectively contacting the resistance element and the annular segment. Therefore, The rotary assembly can be continuously rotated to prevent accidental breakage without short-circuiting.

12 Claims, 8 Drawing Sheets

VARIABLE RESISTOR WITHOUT ROTATION ANGLE LIMITATION AND HAVING REGULAR CHANGES IN RESISTANCE VALUE

BACKGROUND OF THE INVENTION

1. Field of the Invention

The present invention relates to variable resistor, especially to a variable resistor that is free of rotation angle limitation and has regular changes in resistance value while turning this variable resistor.

2. Description of the Related Art

A variable resistor is a passive component having three terminals that is commonly used to adjust a level of analog signals, such as a volume control of a radio or a brightness control of a lamp.

With reference to FIG. 8, a conventional rotary variable resistor comprises a casing (60), a substrate (61), a resistance element (62), a shaft mount (63), a shaft (64), a wiper mount (65) and a wiper (66).

The casing (60) has a stopper (600) formed inside the casing and extends from an inner bottom of the casing (60).

The substrate (61) is mounted on the casing (60) and has a through hole (610) and multiple copper foils (611). The copper foils (611) are formed on a front surface of the substrate (61) and includes a first copper foil (611*a*), a second copper foil (611*b*) and a third copper foil (611*c*). The first copper foil (611*a*) has an annular segment surrounding the through hole (610). The second copper foil (611*b*) and the third copper foil (611*c*) are respectively formed beside the first copper foil (611*a*) with a gap.

The resistance element (62) is mounted on the substrate (61), surrounds the annular segment of the first copper foil (611*a*) and has two ends respectively connecting the second copper foil (611*b*) and the third copper foil (611*c*). A maximal and constant resistance value of the conventional variable resistor can be measured between the second and third copper foil (611*b*, 611*c*).

The shaft mount (63) is mounted on a back surface of the substrate (61) and has a bushing (630) extending into the through hole (610) of the substrate (61).

The shaft (64) is mounted through the bushing (630) of the shaft mount (63).

The wiper mount (65) is attached to an end of the shaft (64) and rotated by the shaft (64) and has a lip (650) longitudinally protruding from an edge of the wiper mount (65) and abutting against the stopper (600) of the casing (60) to limit the rotating angle of the wiper mount (65).

The wiper (66) is electrically conductive, is mounted on the wiper mount (65), rotates with the wiper mount (65) and has multiple first contacts (660) and multiple second contacts (661). The first contacts (660) contact the resistance element (62). The second contacts (661) contact the annular segment of the first copper foil (611*a*).

When the wiper (66) rotates with the wiper mount (65), the contacts (660, 661) then slide on the resistance element (62) and the annular segment of the first copper foil (611*a*) and thereby changes resistance value between the first copper foil (611*a*) and another copper foil (611*b* or 611*c*). The stopper (600) of the casing (60) limits a rotation angle range of the wiper (66) by stopping the lip (650) of the wiper mount (65) to prevent the first contacts (660) of the wiper (66) from contacting the copper foils (611*a*, 611*b*, 611*c*) and causing a short circuit.

However, since the wiper (66) cannot rotate a complete revolution, rotating the shaft (64) with an inappropriate force may easily break the attachment between the shaft (64) and the wiper mount (65).

To overcome the shortcomings, the present invention provides a variable resistor that is free of rotation angle limitation to mitigate or obviate the aforementioned problems.

SUMMARY OF THE INVENTION

The main objective of the invention is to provide a variable resistor that is free of rotation angle limitation.

A variable resistor has a substrate, an insulating film, a resistance element, a rotary assembly and a wiper.

The substrate is mounted on a casing and has a through hole, a first terminal, a second terminal and a third terminal. The first terminal has an annular segment surrounding the through hole. The second terminal is separated from the first terminal. The third terminal is separated from the first terminal and the second terminal and has a semi-circular segment disposed adjacent to the annular segment of the first terminal.

The insulating film covers the second terminal and the semi-circular segment of the third terminal, and has a central hole corresponding to the annular segment of the first terminal and has two gaps respectively corresponding to the second terminal and a distal end of the semi-circular segment.

The resistance element is mounted on the insulating film and respectively contacts the second terminal and the distal end of the semi-circular segment of the third terminal through the gaps.

The rotary assembly is mounted on the substrate and attached to the casing.

The wiper is attached to and rotated by the rotary assembly and has multiple first contacts contacting the resistance element and multiple second contacts contacting the annular segment of the first terminal.

A user can rotate the shaft complete revolution without any limitation of rotation angle and avoid easily breaking the rotation structure of the variable resistor.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
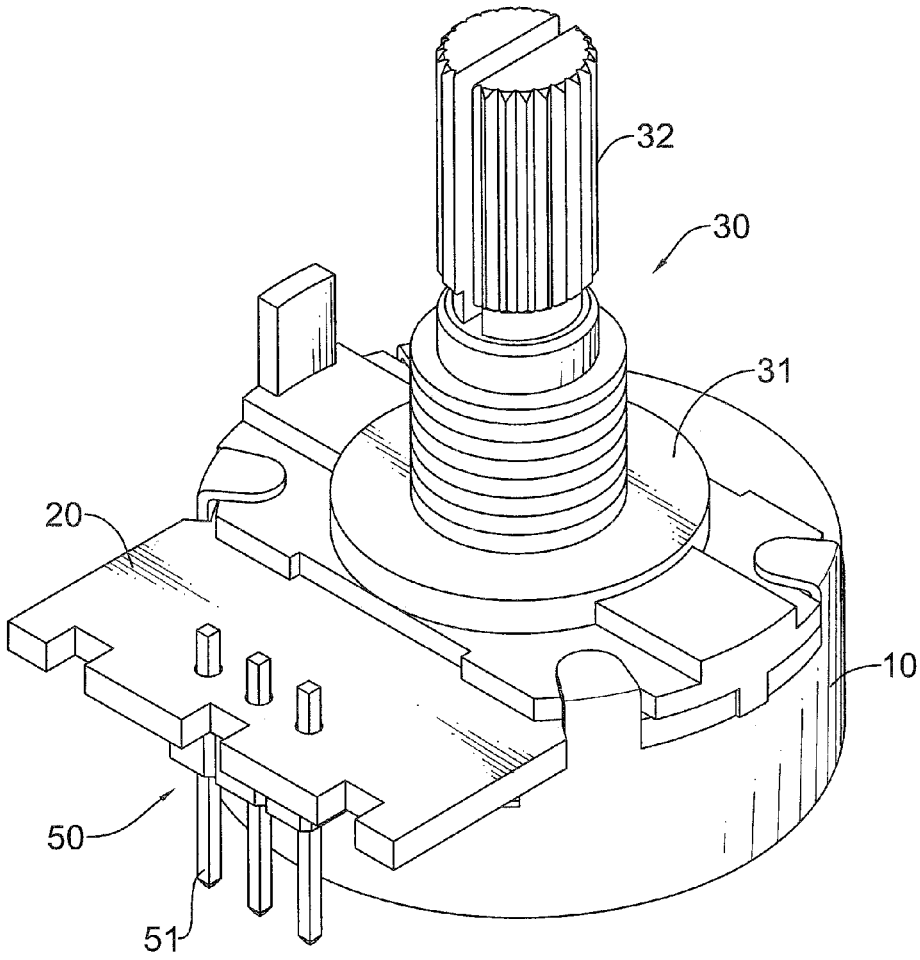
FIG. 1 is a perspective view of a variable resistor in accordance with the present invention.
Figure 2:
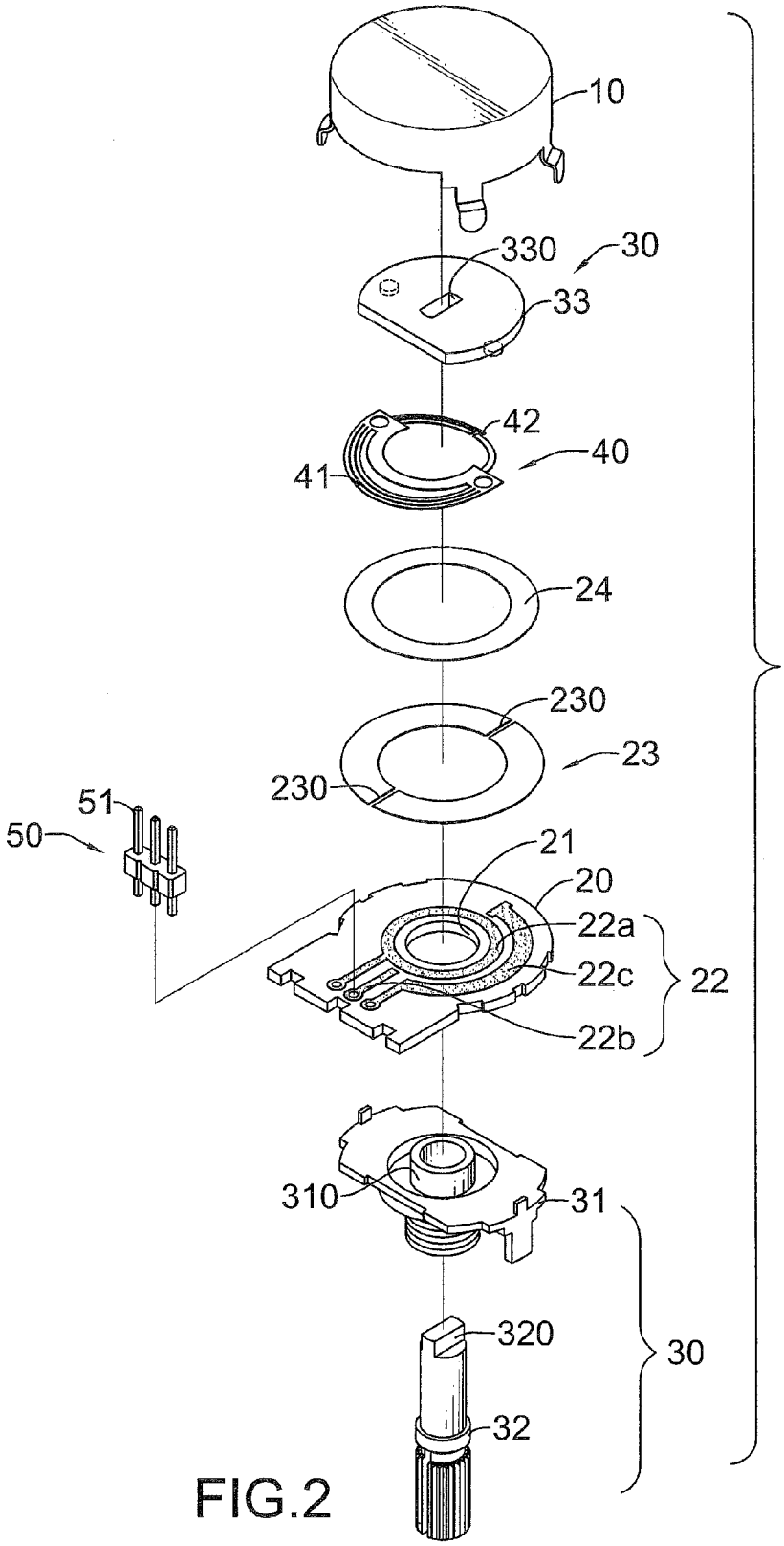
FIG. 2 is an exploded perspective view of the variable resistor in FIG. 1.
Figure 4:
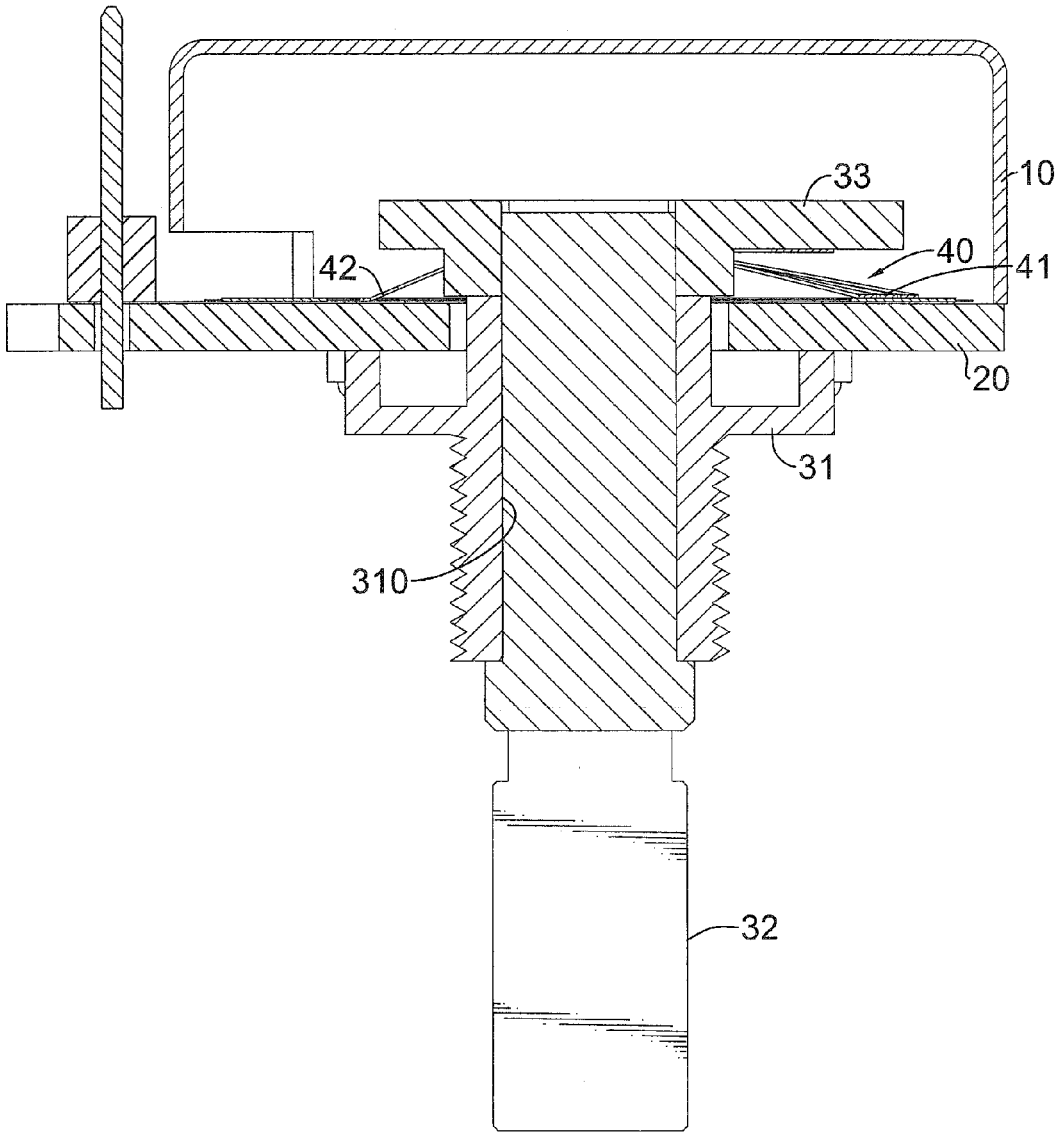
FIG. 4 is a cross sectional view of the variable resistor in FIG. 1.

With reference to FIGS. 1, 2 and 4, a variable resistor in accordance with the present invention comprises a casing (10), a substrate (20), an insulating film (23), a resistance element (24), a rotary assembly (30), a wiper (40) and an optional pin assembly (50).

The casing (10) has an open end and may have multiple clamping tabs.

The substrate (20) is mounted on the open end of the casing (10) and has a front surface, a rear surface, a through hole (21), multiple optional soldering holes and a terminal group (22). The soldering holes are formed through the substrate (20). The terminal group (22) is conductive and formed on the front surface of the substrate (20) and has a first terminal (22*a*), a second terminal (22*b*) and a third terminal (22*c*). The first terminal (22*a*) has an annular segment surrounding the through hole (21) and a connector extending from the annular segment and connecting to a soldering hole. The second terminal (22*b*) is separated from the first terminal (22*a*) and has a connector adjacent to the connector of the first terminal (22*a*) and connecting a soldering hole. The third terminal (22*c*) is separated from the first terminal (22*a*) and the second terminal (22*b*) and has a semi-circular segment and a connector. The semi-circular segment is disposed adjacent to the annular segment of the first terminal (22*a*) and has a proximal end and distal end. The connector of the third terminal (22*c*) extends from the proximal end of the semi-circular segment and adjacent to the connector of the second terminal (22*b*) and connecting a soldering hole. The terminals (22*a*, 22*b*, 22*c*) may be implemented as copper foil or the like.

Figure 3:
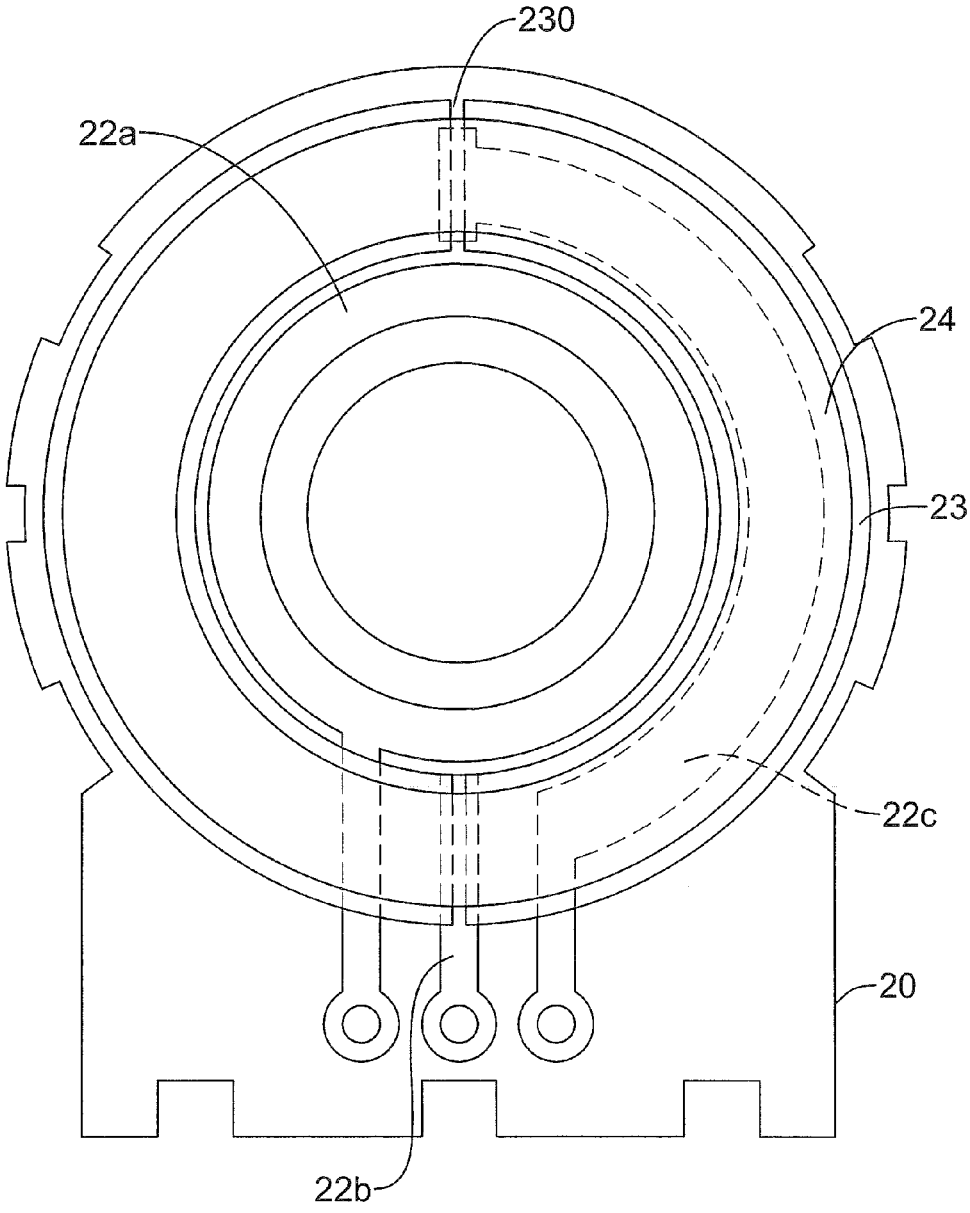
FIG. 3 is a top view of a substrate of the variable resistor in FIG. 2.

With further reference to FIG. 3, the insulating film (23) is annular and has a central hole and two gaps (230), covers the second terminal (22*b*) and the semi-circular segment of the third terminal (22*c*). The central hole of the insulating film (23) corresponds to the annular segment of the first terminal (22*a*). The gaps (230) respectively correspond to the second terminal (22*b*) and the distal end of the semi-circular segment of the third terminal (22*c*).

The resistance element (24) is annular, is mounted on the insulating film (23) and respectively contacts the second terminal (22*b*) and the distal end of the semi-circular segment of the third terminal (22*c*) through the gaps (230) of the insulating film (23). The gaps (230) allow a constant resistance value to be measured between the second and third terminal (22*b*, 22*c*). The resistance element (24) may be implemented as carbon film.

The rotary assembly (30) is mounted on the substrate (20) and attached to the casing (10) and may have a shaft mount (31), a shaft (32) and a wiper mount (33). The shaft mount (31) is mounted on the rear surface of the substrate (20), may be clamped by the clamping tabs of the casing (10) and has a pushing (310). The bushing (310) corresponds to and is mounted in the through hole (21) of the substrate (20). The shaft (32) is mounted through the bushing (310) of the shaft mount (31) and has a connecting end (320) extending out from the bushing (310). The wiper mount (33) is attached to the connecting end (320) of the shaft (32) maybe with a mounting slot (330) and is rotated by the shaft (32) and faces the front surface of the substrate (20).

Figure 5:
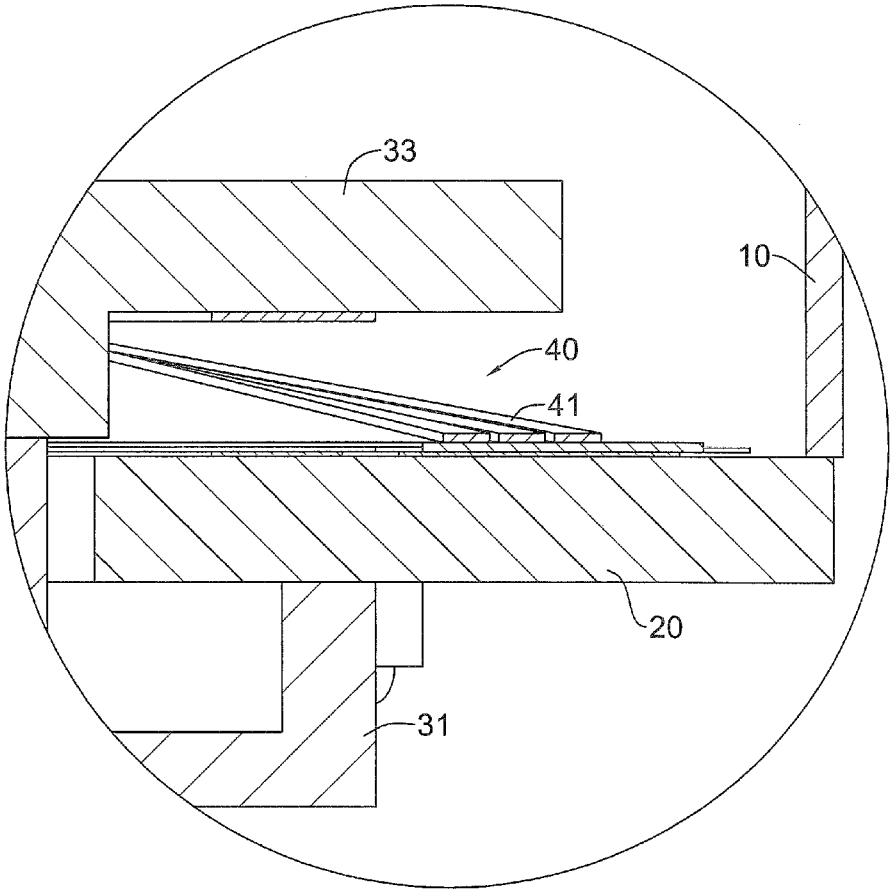
FIG. 5 is an enlarged view of the variable resistor in FIG. 4 showing first contacts of a wiper contacting a resistance element.
Figure 6:
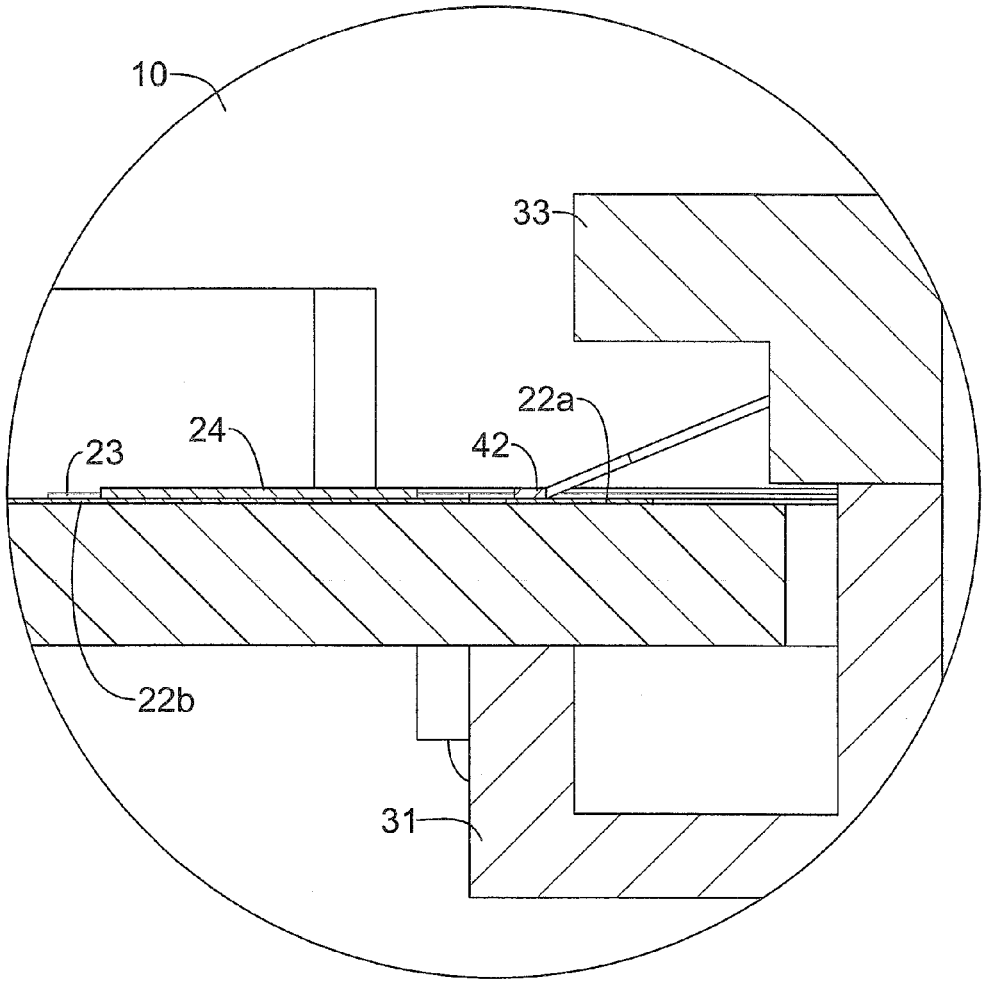
FIG. 6 is an enlarged view of the variable resistor in FIG. 4 showing a second contacts of the wiper contacting a first terminal.

The wiper (40) is attached to and rotated by the rotary assembly (30), has multiple first contacts (41) and multiple second contacts (42) and may be mounted on the wiper mount (33). With further reference to FIGS. 5 and 6, the first contacts (41) contact the resistance element (24). The second contacts (42) contact the annular segment of the first terminal (22*a*) of the terminal group (22).

The pin assembly (50) is mounted on the substrate (20) and has a base and multiple pins (51). The multiple pins (51) are respectively formed through the base, extend through the soldering holes of the substrate (20) and are soldered on the connectors of the terminals (22*a*, 22*b*, 22*c*).

Figure 7:
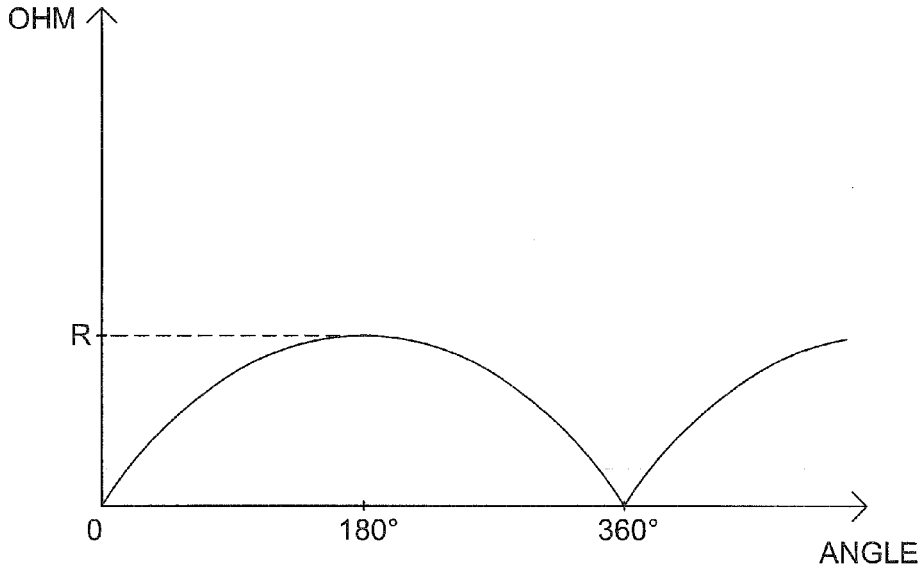
FIG. 7 is a scheme view showing a resistance value of the present invention changes correspondingly to a rotation angle.
Figure 8:
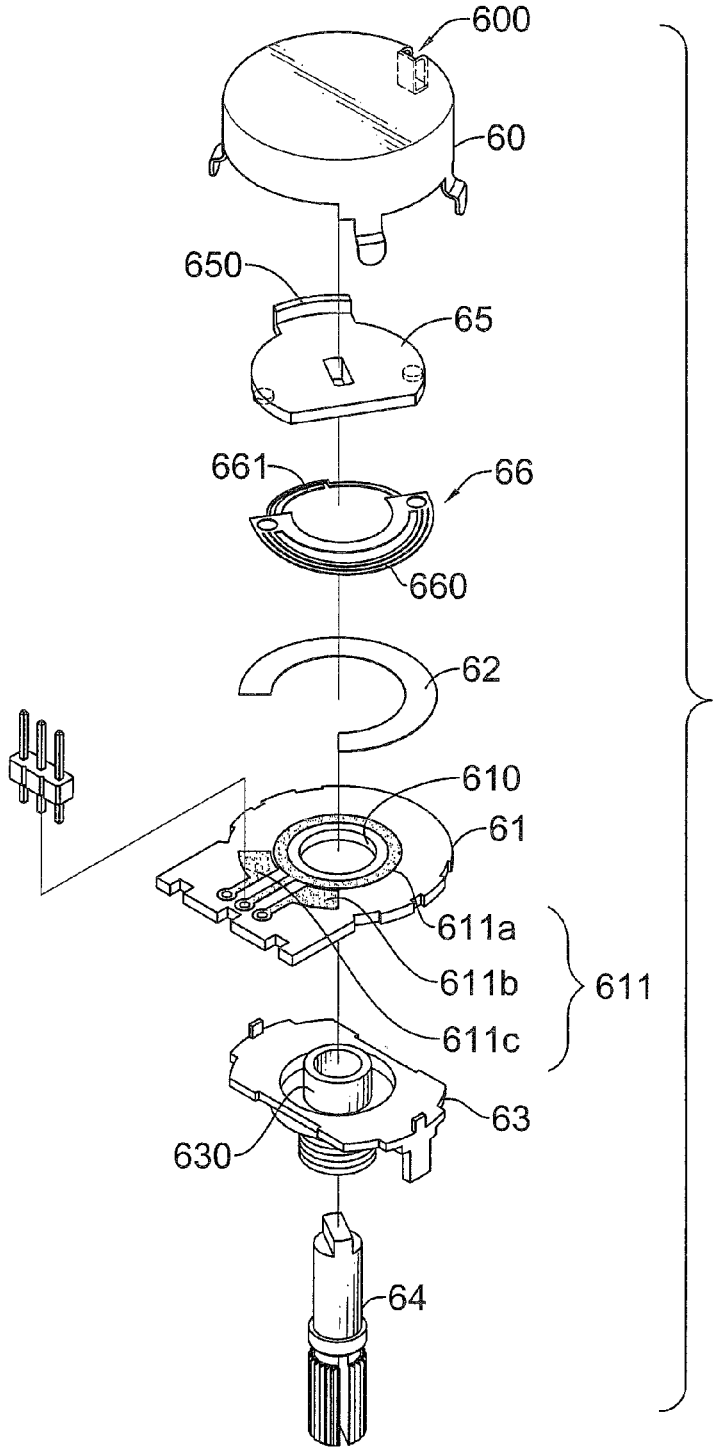
FIG.8 PRIOR ART
FIG. 8 is an exploded perspective view of a variable resistor in accordance with the prior art.

When the shaft (32) is rotated and drives the wiper (40) mounted on the wiper mount (33) rotating, the first contacts (41) and the second contacts (42) of the wiper (40) then respectively slides on the resistance element (23) and the annular segment of the first terminal (22*a*). Therefore, a resistance value between the first terminal (22*a*) and another terminal (22*b* or 22*c*) is changed. With further reference to FIG. 7, as the shaft (32) rotates, the change of resistance value between the first terminal (22*a*) and another terminal (22*b* or 22*c*) can be represented as a continuously and periodically parabolic curve.

Since the insulating film (23) covers the second terminal (22*b*) and the third terminal (22*c*), the wiper (40) can slide with a complete revolution over the resistance element (24) without contacting the second and third terminal (22*b*, 22*c*). Therefore, the shaft (32) can be rotated by a complete revolution without any limitation of rotation angle and avoid easy breakage of the rotary assembly (30) of the variable resistor.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A variable resistor comprising:

a casing having an open end a substrate being mounted on the open end of the casing and having a front surface;

a rear surface;

a through hole; and a terminal group being conductive and formed on the front surface of the substrate and having a first terminal having an annular segment surrounding the through hole and a connector extending from the annular segment;

a second terminal being separated from the first terminal and having a connector adjacent to the connector of the first terminal; and a third terminal being separated from the first terminal and the second terminal and having a semi-circular segment being disposed adjacent to the annular segment of the first terminal and having a proximal end and distal end; and a connector extending from the proximal end of the semi-circular segment adjacent to the terminal of the second terminal;

an insulating film being annular, covering the second terminal and the semi-circular segment of the third terminal, surrounding the annular segment and having a central hole corresponding to the annular segment of the first terminal; and two gaps respectively corresponding to the second terminal and the distal end of the semi-circular segment of the third terminal;

a resistance element being annular, being mounted correspondingly on the insulating film and respectively contacting the second terminal and the distal end of the semi-circular segment of the third terminal through the gaps of the insulating film;

a rotary assembly being mounted on the substrate and attached to the casing; and a wiper being attached to and rotated by the rotary assembly and having multiple first contacts contacting the resistance element; and multiple second contacts contacting the annular segment of the first terminal of the terminal group.

2. The variable resistor as claimed in claim 1, wherein the rotary assembly has a shaft mount being mounted on the rear surface of the substrate and having a bushing corresponding to and being mounted in the through hole of the substrate;

a shaft being mounted through the bushing of the shaft mount and having a connecting end extending out from the bushing; and a wiper mount being attached to the connecting end of the shaft and being rotated by the shaft and facing the front surface of the substrate; and the wiper is mounted on the wiper mount.

3. The variable resistor as claimed in claim 2, wherein the substrate further has multiple soldering holes being formed through the substrate and the connectors of the terminals of the terminal group respectively connecting the terminals to the soldering holes; and the variable resistor further comprises a pin assembly being mounted on the substrate and having a base; and multiple pins being respectively formed through the base, extending through the soldering holes of the substrate and being soldered on the connectors of the terminals of the terminal group.

4. The variable resistor as claimed in claim 3, wherein the terminals of the terminal group are copper foils.

5. The variable resistor as claimed in claim 3, wherein the resistance element is carbon film.

6. The variable resistor as claimed in claim 2, wherein the casing further has multiple clamping tabs; and the shaft mount is clamped by the clamping tabs of the casing.

7. The variable resistor as claimed in claim 6, wherein the terminals of the terminal group are copper foils.

8. The variable resistor as claimed in claim 6, wherein the resistance element is carbon film.

9. The variable resistor as claimed in claim 2, wherein the terminals of the terminal group are copper foils.

10. The variable resistor as claimed in claim 2, wherein the resistance element is carbon film.

11. The variable resistor as claimed in claim 1, wherein the terminals of the terminal group are copper foils.

12. The variable resistor as claimed in claim 1, wherein the resistance element is carbon film.

* * * * *